US005168117A

United States Patent [19]

Anderson

[11] Patent Number: 5,168,117

[45] Date of Patent: Dec. 1, 1992

[54] ELECTROMAGNETIC PICKUP WITH FLEXIBLE MAGNETIC CARRIER

[75] Inventor: Thomas S. Anderson, Thousand Oaks, Calif.

[73] Assignee: Tom Anderson Guitarworks, Newbury Park, Calif.

[21] Appl. No.: 640,600

[22] Filed: Jan. 14, 1991

[51] Int. Cl.[5] ..... G10H 3/18; G10H 3/14

[52] U.S. Cl. ..... 84/726; 84/728; 29/609.1

[58] Field of Search ..... 84/723, 725-729, 84/743; 29/602.1, 609.1

[56] References Cited

U.S. PATENT DOCUMENTS 3,916,751 11/1975 Stich ..... 84/728
4,026,178 5/1977 Fuller ..... 84/726
4,145,944 3/1979 Helpinstill, II .
4,220,069 9/1980 Fender ..... 84/726
4,320,681 3/1982 Altilio ..... 84/726
4,372,186 2/1983 Aaroe .
4,412,454 11/1983 Yamashita et al. ..... 336/20 X
4,442,749 4/1984 DiMarzio et al. ..... 84/728
4,524,667 6/1985 Duncan ..... 84/726

*Primary Examiner*—William M. Shoop, Jr.
*Assistant Examiner*—Jeffrey W. Donels
*Attorney, Agent, or Firm*—Ladas & Parry

[57] ABSTRACT

A pickup for an electrical musical instrument of the type having a plurality of strings, the pickup including a non-magnetized pole piece for each string, each pole piece having a first end for confronting its associated string and a second end. End pieces having a generally planar surface are press fit on the pole pieces so that the second ends of the pole pieces are disposed adjacent a generally planar surface of one end piece. A coil of wire is wound around the at least one pole piece. Magnetic material in a deformable plastic carrier having a generally planar surface is disposed adjacent the generally planar surface of said end piece, the carrier being deformed to occupy surface discontinuities between the second end of the at least one pole piece and the carrier.

12 Claims, 3 Drawing Sheets

FIG. 1
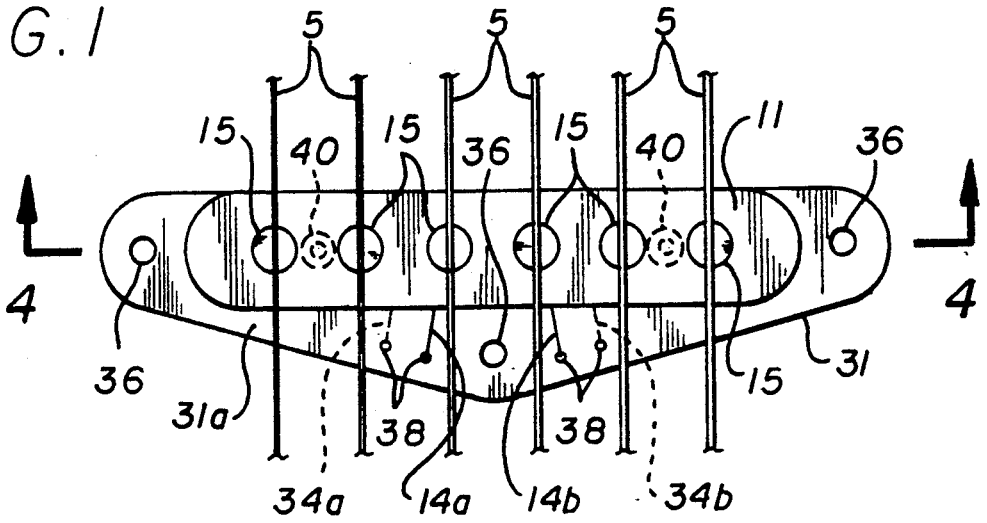
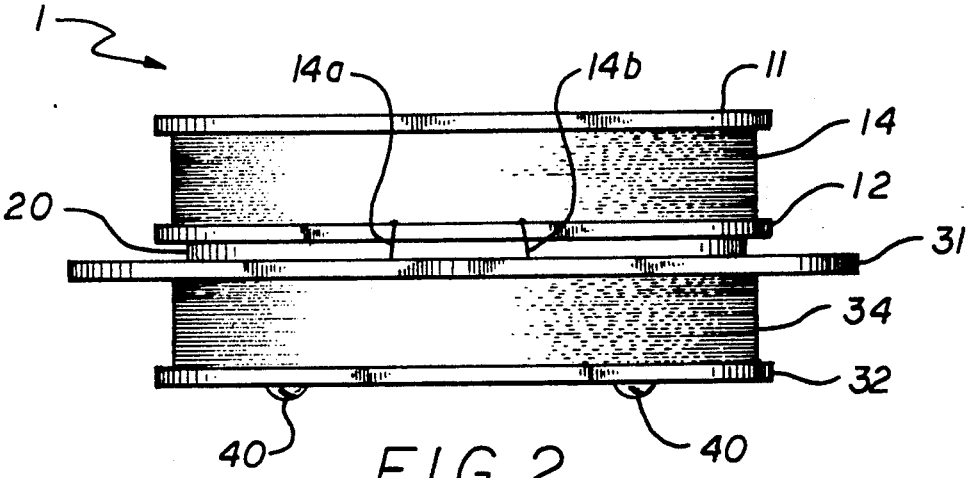
FIG. 2
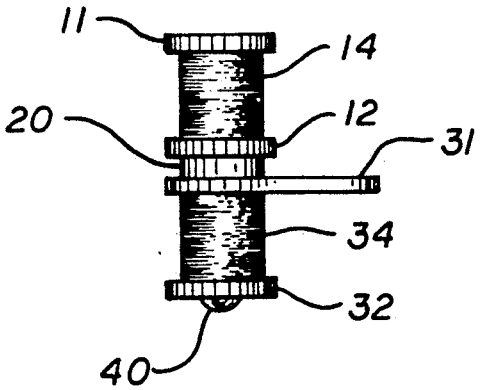
FIG. 3

FIG. 4
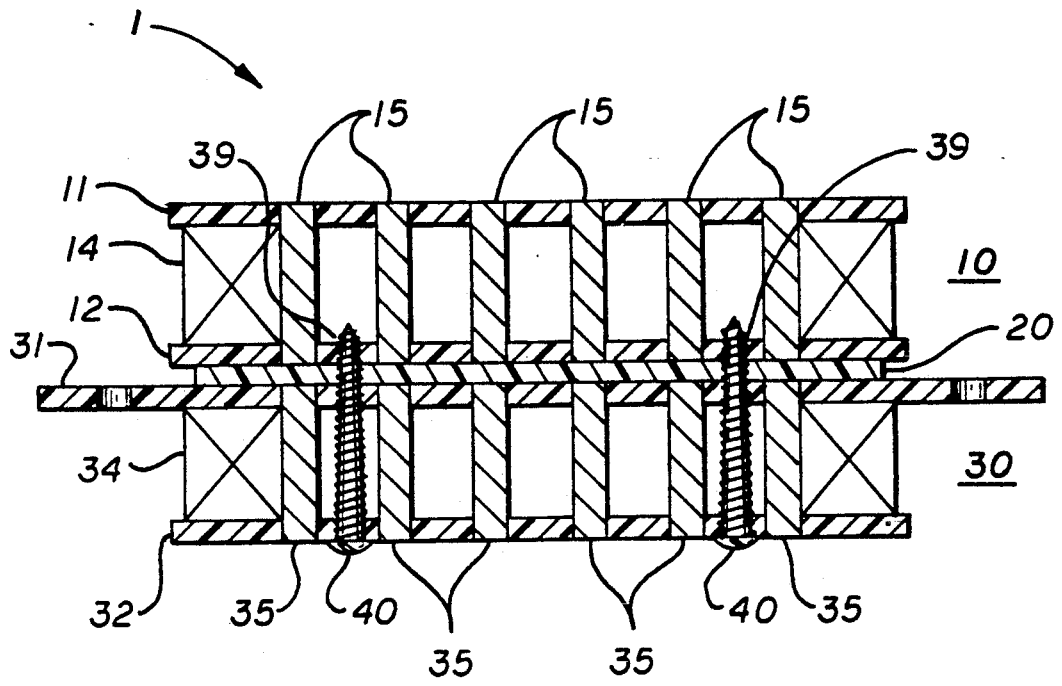
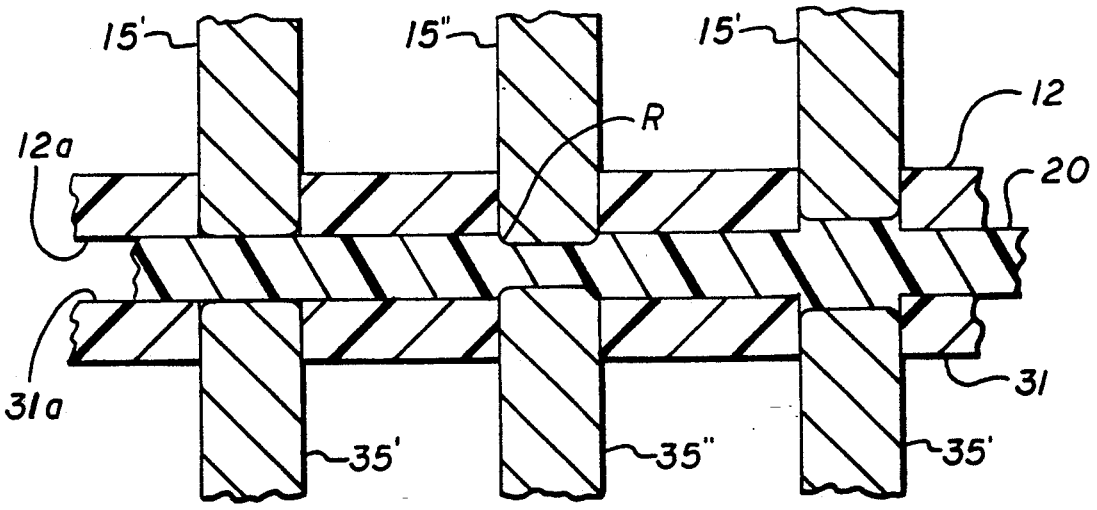
FIG. 5

ELECTROMAGNETIC PICKUP WITH FLEXIBLE MAGNETIC CARRIER

TECHNICAL FIELD

This invention relates to electromagnetic pickup of the type used with stringed instruments, especially guitars.

BACKGROUND OF THE INVENTION

Guitar pickups are certainly well known since the first electric guitar appeared in the 1930's. Pickups must be sensitive to the vibrations of the metallic strings used with a guitar, and ideally insensitive to environment electromagnetic noise and to microphonic noise caused by quickly relative movement of pickup components, such as movement in the wires forming the coil of a pickup.

In the prior art, it was quite common to use a coil wound on magnetized pole pieces to form a pickup. Indeed, the first commercial pickups sold by Leo Fender probably had such a design. Later, Les Paul proposed using a pair of stacked coils wound on in-line magnetized pole pieces, with the coils being connected out of phase with each other so as to help cancel environmental noise. Using two coils, either stacked on top of each other, or arranged side-by-side, and connected out of phase with each other became known as hum-bucking since the design was less sensitive to the 60 Hz hum noise found in modern environments. Seymour Duncan also made stacked hum-bucking pickups, but he used a set of common magnetized pole pieces, as opposed to the separate in-line magnetized pole pieces used by Les Paul.

Instead of magnetizing the pole pieces themselves, Rickenbacker used non-magnetized pole pieces. Rickenbacker's earliest pickups featured a horseshoe shaped magnet which surrounded not only the pole pieces and coil, but also the strings of the guitar. By the late 1960's, Rickenbacker used non-magnetic pole pieces in combination with a rather flat, thin ceramic magnet. Such a design was also the subject of Fender's U.S. Pat. No. 4,220,069, the disclosure of which is hereby incorporated herein by reference.

In order to reduce microphonic noise caused by relative movement within a pickup, such as by movement of the wires in the pickup's coil or in the bobbin to plateplate connection, various impregnating media have be used in the prior art, including paraffins and epoxy resins.

For a more complete history of guitar pickups, the reader is referred to Chapter 3 of *Guitar Electronics: A Workbook* by Donald Brosnac, published by d. B. Music Company, Ojai, Calif., the disclosure of which is hereby incorporated herein by reference.

While the have been many improvements made to guitar pickups over the years, this is still a need for a guitar pickup which is sensitive to the vibrating strings, yet relatively insensitive to environmental hum and not subject to generating microphonic noise. The present pickup has been found to be sensitive to vibrating strings, while still being relatively insensitive to hum and quiet.

BRIEF DESCRIPTION OF THE PRESENT INVENTION

The present invention provides a pickup for an electrical musical instrument of the type having a plurality of strings, said pickup including at least one non-magnetized pole piece having a first end for confronting a string of the instrument and a second end. End pieces having a generally planar surface and at least one opening therein for receiving the at least one pole piece are press fit on the at least one pole piece so that the second end of the at least one pole piece is disposed adjacent a generally planar surface of one end piece. A coil of wire is wound around the at least one pole piece. Magnetic material in a deformable plastic carrier having a generally planar surface is disposed adjacent the generally planar surface of said end piece, the carrier being deformed to occupy surface discontinuities between the second end of the at least one pole piece and the carrier.

The present invention also provides a method of manufacturing an electromagnetic pickup. The method includes the steps of winding a coil on at least one pole piece disposed between two end pieces, at least one of which has a surface through which said at least one pole piece is visible. Thereafter a deformable magnetic carrier is disposed adjacent said surface and heat and pressure are applied to the carrier so that the carrier deforms to occupy surface discontinuities between the at least one pole piece and the carrier.

DESCRIPTION OF THE FIGURES

FIG. 1 is a top views of a stacked guitar pickup which utilizes the present invention;

FIG. 2 is a side view of the stacked guitar pickup of FIG. 1;

FIG. 3 is an end view of the stacked guitar pickup of FIGS. 1 and 2;

FIG. 4 is a section view of the stacked guitar pickup of FIGS. 1–3 taken along the section line 4—4 shown in FIG. 1;

FIG. 5 is an enlarged, partial section view showing surface discontinuities filled with a deformable carrier material.

DETAILED DESCRIPTION

Figure 6:
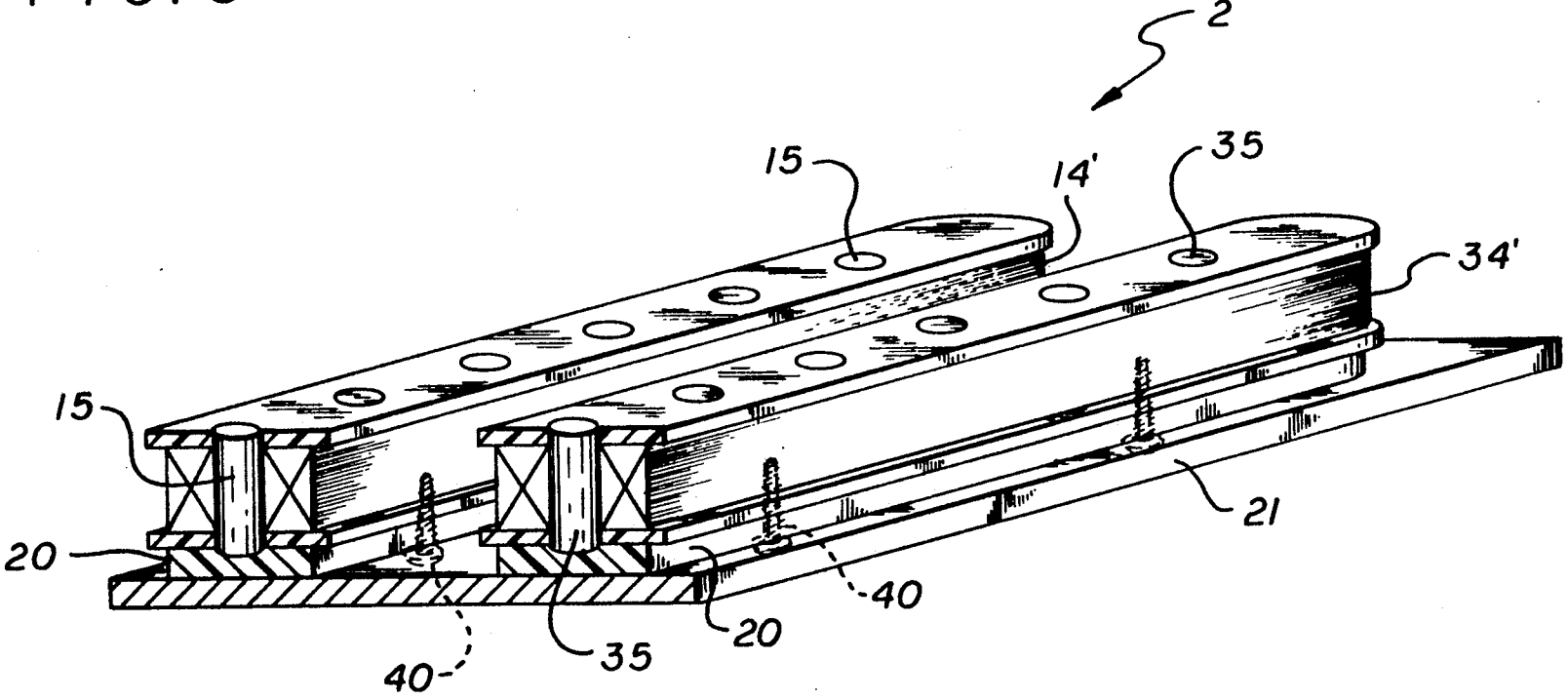
FIG. 6 is a perspective view, partially in section, of an alternative embodiment of the present invention.

FIGS. 1, 2, and 3 are top, side and end views of a stacked guitar pickup 1 which utilizes the present invention. FIG. 4 is a section view through the pickup 1. The pickup 1 has two stacked coils 14 and 34, namely an upper coil 14 and a lower coil 34, which may be connected in a conventional hum bucking arrangement, that is, with the coils 14 and 34 electrically coupled out of phase with each other so that environmental electromagnetic noise (hum) is cancelled. Each coil 14 and 34 is typically manufactured separately, and then the two individual coils are brought together and assembled into a stack as shown in the figures.

Each coil 14, 34 is wrapped around a set of non-magnetized pole pieces 15, 35, preferably formed from grade 12L14 free machining steel, after first electrically insulating the pole pieces from the wire of the coil using a suitable insulating medium (not shown—a thin insulating tape may be used). The number of pole pieces in each set usually corresponds to the number of strings 5 on the guitar (or other stringed instrument) with which the pickup 1 is used. Since guitars commonly have six strings, six pole pieces are shown in the set associated with the upper coil 14 and in the set associated with the lower coil 34 (see FIG. 4). The number of strings used in a stringed instrument is a matter of design choice, as is the number of pole pieces in the pickup 1. When the pickup is installed in a guitar, the strings 5 are usually centered immediately over the pole pieces 15 of the upper coil 14. The coils 14 and 34 each preferably comprise about 4,000 to 7,000 turns of gauge 42 to 43 copper wire. The precise gauge used and the number of turns is a matter of design choice, although each coil would typically have the same number of turns and the same gauge as the other coil.

The pole pieces 15 associated with the upper coil 14 are preferably press fit into end pieces 11 and 12 while the pole pieces 35 associated with the lower coil 34 are preferably press fit into end pieces 31 and 32. The end pieces are preferably punched with holes to receive the ends of the pole pieces with a press fit and also with mounting holes 36, soldering holes 38, and other holes 37 and 39 which may be used during the winding and assembly processes. Those skilled in the art will appreciate that instead of using end pieces 11, 12, 31, and 32, that performed plastic bobbins may alternatively be used, in which case the bobbins automatically provide the insulating medium between the pole pieces and the wire of the coils. I prefer using vulcanized fiber for the end pieces because of the finished look and feel provided by that product.

When the pole pieces are press fit into the end pieces 12 and 31 (or into bobbins, if used), the ends of the pole pieces are often close to flush, but not exactly flush, with the outer surfaces 12*a* and 31*a* of the end pieces (or bobbins), as can be seen in FIG. 5. In FIG. 5 the lack of flushness is exaggerated for ease of illustration. The significance of this lack of flushness will be discussed later. The ends of the pole pieces are preferably slightly radiused as shown at R in FIG. 5 to simplify the press fitting of them into the end pieces.

After winding the coil 14 and 34, the two coils are made up into a stack by fixing them on either side of a flexible bar magnet 20 so that the pole pieces 15 and 35 align with each other. I prefer using a flexible magnet 20 made of Neodymium magnetic material disposed in a flexible ruberized plastic carrier. A suitable flexible magnetic product is available from All Magnetics of Los Angeles, Calif. under the name ND-Plastiloy. As can be seen in FIG. 3, the flexible magnet 20 preferably has a width of approximately the same width as that of the coils 14, 34, namely approximately 0.5 inch and, as can be seen in FIG. 2, it preferably has a length about the same as the length of a coil, typically about 2⅜ inches. The thickness of the flexible magnetic is preferably 3/32 inch. It is magnetized across its thickness such that one pole of the magnet confronts the poles of one of the coils while the other pole of the magnet confronts the poles of the other coil. The magnet 20 should have a length and width of approximately the same (if not greater) size as the coils 14 and 34, so that coil 14 will be more sensitive to the strings 5 than be will coil 34.

The two coils are fixed together by a pair of screws 40, preferably having a sheet metal thread so that they easily bite into the vulcanized fibre preferably used as the end piece material. The screws 40 are preferably placed in alignment with the pole pieces so that when the screws are tightened, a more uniform pressure is applied to the flexible magnet 20, especially across the width of the pickup. The flexible magnet 20 is drilled with holes aligning with holes 39 in end pieces 12, 31 and 32 to accommodate screws 40. After fixing the two coils together, the ends of their wires are then individually connected to solder holes 38. The wire ends 14*a* and 14*b* of coil 14 can be seen traversing across the side faces of end piece 12 and flexible magnet 20 in FIG. 2 and thence to the two inner most solder holes 38 in end piece 31 (see FIG. 1). The wire ends 34*a* and 34*b* from the lower coil 34 are connected to the two outer most solder holes 38 and are shown in FIG. 1 in phantom lines since they traverse the hidden side of end piece 31 in the figure. The solder holes 38 are used the couple the coils 14 and 34 to conventional electronics used in guitars and guitar amplifiers by means of a conventional wiring harness. The guitar electronics typically include switches which permit the two coils in a stack to be used independently of each other or in a hum bucking arrangement.

After assembly of the pickup stack 1 as shown in FIGS. 1–4, the stack is then emersed in a bath of 129° paraffin heated to a temperature of 130°–140° F. for approximately one-half hour. Since the flexible magnet 20 tends to lose its magnetic properties when heated above about 140° F., the temperature of the paraffin bath must not be allowed to go too high. The heated paraffin soaks into the coils 14 and 34, so that the wires of the coils do not move in use, and also heats the plastic carrier of the flexible magnet 20 such that it deforms slightly, either to move out of the way of the ends of the pole pieces when they protrude beyond the surface of their associated end piece (or bobbin)—as shown at numerals 15″ and 35″ in FIG. 5—or to move into the void left by the pole pieces when they are not quite fully inserted into an end piece (or bobbin)—as depicted at numerals 15′ and 35′ in FIG. 5. The use of a flexible, deformable magnet 20 provides an extremely low noise guitar pickup 1, especially when wired in a hum bucking arrangement. The hum bucking arrangement reduces environmental noise (typically 60 Hz electromagnetic noise common in the United States) and the paraffin wax and flexible, deformable magnet 20 reduces microphonic noise caused by relative movement of pickup components. The flexible magnet 20 may have a shock absorbing capability which seems to desensitize the pickup to microphonic noise. The deformability of the magnet 20 also assures excellent and uniform magnetic coupling between the magnet 20 and the pole pieces 15, 35.

FIG. 6 is a side sectional view an alternative embodiment of a pickup 2 having two coils 14′ and 34′ in a side-by-side arrangement. In this embodiment each coil 14′ and 34′ is similar to the coils 14 and 34 of FIGS. 1–4, except that the pole pieces of each coil 14′ and 34′ confront the strings 5 of the guitar or other stringed instrument with which the pickup is used. Each coil also has its own flexible, deformable magnet 20, the two magnets being arranged such that a north pole of one magnet contacts of the pole pieces of one of the two coils 14′ or 34′ while the south pole of the other magnet contacts the pole pieces of the other coil. After the coils 14′ and 34′ are wound, they are assembled into the pickup unit depicted in FIG. 6 with the two flexible magnets 20 arranged as discussed above and fixed to a metal base plate—preferably made of brass material—21 using two pairs of screws 40, one pair being associated with each coil and each pair being disposed in line with the pole pieces 15, 35 of the associated coil so as to provide the uniform pressure as mentioned with respect to the embodiment of FIGS. 1–4. After assembly, unit 2 is emersed in a bath of 129° paraffin heated to the range of 130° to 140° F. for approximately one-half hour. The paraffin soaks into the coils and the heat deforms the flexible magnets 20 to provide uniform and excellent magnetic coupling between the pole pieces and their associated magnet 20 as discussed above with reference to FIG. 5. The flexible magnetic material 20 also reduces microphonic noise as mentioned above.

Having described the invention with respect to two embodiments thereof, modification may now suggest itself to those skilled in the art. The invention itself is not, therefore, to be limited to the disclosed embodiments except as required by the appended claims.

What is claimed is:

1. A pickup for an electrical musical instrument of the type having a plurality of strings, said pickup comprising:

(a) at least one non-magnetized pole piece having a first end for confronting a string of said instrument and a second end;

(b) a coil of wire wound around said at least one pole piece;

(c) end piece means defining a generally planar surface and having at least one opening therein for receiving said at least one pole piece, said second end of said at least one pole piece being disposed adjacent said generally planar surface; and (d) magnetic material disposed in a deformable plastic carrier, the carrier having a generally planar surface disposed adjacent the generally planar surface of said end piece means, said carrier being deformed to occupy surface discontinuities between the second end of said at least one pole piece and said carrier.

2. The pickup of claim 1, wherein said magnetic material is neodymium, said carrier is a flexible rubberized plastic carrier and further including means for applying pressure between said end piece means and said carrier.

3. An electromagnetic pickup comprising:

(a) a first coil means including a plurality of first pole pieces mounted in a first support means having a generally planar surface, each of the first pole pieces having first and second ends, said second ends of said first pole pieces being disposed adjacent said generally planar surface of said first support means;

(b) a second coil means including a plurality of second pole pieces mounted in a second support means having a generally planar surface, each of the second pole pieces having first and second ends, said first ends of said second pole pieces being disposed adjacent said generally planar surface of said second support means;

(c) at least one magnetic, deformable carrier means disposed between the generally planar surfaces of said first and second support means, said magnetic carrier means being deformable to occupy surface discontinuities between the second ends of said first pole pieces and said carrier and to occupy surface discontinuities between the first end of said second pole pieces and said carrier.

4. The electromagnetic pickup of claim 3 having two magnetic, deformable carrier means and a metal plate disposed between same.

5. The electromagnetic pick-up of claim 4 wherein said first pole piece means are arranged in a straight line and said second pole pieces are also arranged in a straight line and wherein fixing means pass through said magnetic, deformable carrier means, through said metal plate and in an alignment with said straight lines, said fixing means applying pressure between said first and second support means and said carrier means.

6. The electromagnetic pickup of claim 3 having a single magnetic, deformable carrier means and wherein said first and second pole piece means are arranged in a straight line and wherein fixing means pass through said second coil means, through said single magnetic, deformable carrier means, and into said first coil means and in alignment with its straight line, said fixing means applying pressure between said first and second support means and said single carrier means.

7. A pickup for an electrical musical instrument of the type having a plurality of strings, said pickup comprising:

(a) at least one non-magnetized pole piece having a first end for confronting a string of said instrument and a second end;

(b) a coil of wire wound around said at least one pole piece;

(c) end piece means defining a generally planar surface and having at least on opening therein for receiving said at least one pole piece, said second end of said at least one pole piece being disposed adjacent said generally planar surface; and (d) magnetic material disposed in a flexible plastic carrier, the carrier having a generally planar surface disposed adjacent the generally planar surface of said end support means, said carrier being deformed to occupy surface discontinuities between the second end of said pole piece and said carrier.

8. The pickup of claim 7, wherein said magnetic material is neodymium and said carrier is a flexible rubberized plastic carrier.

9. A method of manufacturing an electromagnetic pickup comprising the steps of:

(a) winding a coil on at least on a pole piece disposed between two end pieces, at least one of which has at least one aperture therein and a surface adjacent said at least one aperture said at least one pole piece being disposed in said at least one aperture;

(b) disposing a deformable magnetic carrier adjacent said surface; and (c) applying pressure and heat to said carrier s that said carrier deforms to occupy surface discontinuities between said at least one pole piece and said carrier.

10. A pickup for an electrical musical instrument of the type having a plurality of strings, said pickup comprising;

(a) a first set of pole pieces, each of which has a first end for confronting a string of said instrument and a second end;

(b) a first coil of wire wound on said first set of pole pieces;

(c) first end piece means having a generally planar surface and having openings therein for receiving said first set of pole pieces, the second ends of said pole pieces being disposed adjacent said generally planar surface;

(d) a second set of pole pieces having a first end and a second end;

(e) a second coil of wire wound around said second set of pole pieces;

(f) second end piece means having a generally planar surface and having openings therein for receiving said second set of pole pieces, said second end of said second set of pole pieces being disposed adjacent said generally planar surface;

(g) magnetic material disposed in a deformable plastic carrier, the carrier having first and second generally planar surfaces, the generally planar surface of said first end piece means being disposed adjacent said first planar surface of said deformable plastic carrier and the generally planar surface of said second end piece means disposed adjacent said second planar surface of said deformable plastic carrier; and (h) means for urging said second end piece means towards the first mentioned end piece means so as to apply pressure to said deformable plastic carrier, said carrier being deformed to occupy surface discontinuities between the second ends of said first and second sets of pole pieces and said carrier.

11. A pickup for a stringed instrument said pickup comprising a first set of non-magnetized pole pieces, each having a first end for confronting a string of said instrument and a second end and further including a second set of non-magnetized pole pieces, each having a first end and a second end; first and second coils of wire respectively wound around said first and second sets of pole pieces; first and second end piece means each defining a generally planar surface and each having openings therein for receiving respectively said first and second sets of pole pieces, said second ends of said sets of pole pieces being disposed adjacent the generally planar surface of the associated end piece means, magnetic material disposed in a flexible plastic carrier, the carrier having two generally planar surfaces, the generally planar surfaces of said first and second end piece means each being disposed adjacent one of the generally planar surfaces of said plastic carrier.

12. The method of claim 9, further including the steps of winding a second coil on at least a second pole piece disposed between two end pieces, at least one of which has a surface through which said at least second pole piece is visible, disposing said surface of said second coil on a surface of said deformable magnetic carrier and wherein said applying step comprises first applying pressure to said deformable magnet as it is positioned between the first mentioned coil and said second coil and subsequently applying heat to said coils and said carrier so that said carrier deforms to occupy surface discontinuities between said pole pieces and said carrier.

* * * * *